US012061052B2

(12) United States Patent
Agata et al.

(10) Patent No.: US 12,061,052 B2
(45) Date of Patent: Aug. 13, 2024

(54) HEAT EXCHANGER AND AIR CONDITIONER HAVING THE SAME

(71) Applicant: SAMSUNG ELECTRONICS CO., LTD., Suwon-si (KR)

(72) Inventors: Yo Agata, Yokohama (JP); Hyunyoung Kim, Yokohama (JP); Sangmu Lee, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 265 days.

(21) Appl. No.: 17/672,183

(22) Filed: Feb. 15, 2022

(65) Prior Publication Data

US 2022/0196333 A1 Jun. 23, 2022

Related U.S. Application Data

(63) Continuation of application No. PCT/KR2021/014998, filed on Oct. 25, 2021.

(30) Foreign Application Priority Data

Dec. 17, 2020 (JP) ..... 2020-209343
Aug. 13, 2021 (KR) ..... 10-2021-0107447

(51) Int. Cl.
*F28D 7/16* (2006.01)
*F28B 1/02* (2006.01)
(Continued)

(52) U.S. Cl.
CPC ..... *F28D 7/103* (2013.01); *F28B 1/02* (2013.01); *F28D 7/12* (2013.01); *F28D 7/1607* (2013.01);
(Continued)

(58) Field of Classification Search
CPC . F28D 7/06; F28D 7/16; F28D 7/1607; F28D 7/1638; F28D 7/1646
See application file for complete search history.

(56) References Cited

U.S. PATENT DOCUMENTS 1,509,566 A * 9/1924 Price ..... F28D 7/06 165/158
3,963,071 A 6/1976 Levin et al.
(Continued)

FOREIGN PATENT DOCUMENTS

GB 191228847 A * 8/1913
JP 61-289290 A 12/1986
(Continued)

OTHER PUBLICATIONS

PCT/ISA/210 dated Dec. 17, 2020 in International Patent Application No. PCT/KR2021/014998.

*Primary Examiner* — Eric S Ruppert
(74) *Attorney, Agent, or Firm* — STAAS & HALSEY LLP

(57) ABSTRACT

A heat exchanger includes a shell and a plurality of tubes. The shell includes a heat exchange region in which a second refrigerant is to be introduced into the shell, so that a heat exchange occurs between the second refrigerant and a first refrigerant which flows through the plurality of tubes. The shell includes an inlet region through which the first refrigerant is introduced into the shell, a reverse region into which the first refrigerant is introduced, after the first refrigerant passes through the heat exchange region, and an outlet region into which the first refrigerant is introduced, after the first refrigerant passes through the reverse region and the heat exchange region, the first refrigerant being discharged out of the shell from the outlet region. The shell includes
(Continued)

partition plates to divide the heat exchange region, the inlet region, the reverse region, and the outlet region.

18 Claims, 11 Drawing Sheets

(51) Int. Cl.
*F28D 7/10* (2006.01)
*F28D 7/12* (2006.01)
*F28F 9/22* (2006.01)

(52) U.S. Cl.
CPC ..... *F28F 9/22* (2013.01); *F28D 7/1646* (2013.01); *F28F 2009/224* (2013.01)

(56) References Cited

U.S. PATENT DOCUMENTS 4,368,778 A * 1/1983 Nishimura ..... F28D 7/06 165/158
2011/0290460 A1 12/2011 Taagepera et al.

FOREIGN PATENT DOCUMENTS

JP 10103795 A * 4/1998
JP 2007-3101 1/2007
JP 2008-20085 A 1/2008
JP 2014-70849 4/2014
JP 2017-3189 A 1/2017
KR 10-2012-0104698 9/2012

* cited by examiner

HEAT EXCHANGER AND AIR CONDITIONER HAVING THE SAME

CROSS REFERENCE TO RELATED APPLICATIONS

This application is a continuation application under 35 U.S.C. § 111(a) of International Application No. PCT/KR2021/014998, filed on Oct. 25, 2021, which claims priority to Japanese Patent Application No. 2020-209343 filed on Dec. 17, 2020, and Korean Patent Application No. 10-2021-0107447 filed on Aug. 13, 2021. The disclosures of each of International Application No. PCT/KR2021/014998, Japanese Patent Application No. 2020-209343, and Korean Patent Application No. 10-2021-0107447 are incorporated by reference herein in their entirety.

BACKGROUND

1. Field

The disclosure relates to a heat exchanger and an air conditioner using the same.

2. Description of the Related Art

As an example heat exchanger, a so-called shell-and-tube heat exchanger is provided that includes a shell and a plurality of tubes provided in the shell, and heat exchange is performed between a first fluid flowing inside the tube and a second fluid flowing outside the tube in the shell.

The shell of the heat exchanger includes an inlet region through which the first fluid is introduced, a heat exchange region in which the second fluid flows to heat-exchange with the first fluid, and an outlet region through which the first fluid flows out.

With regard to such a configuration, Japanese Patent Laid-Open No. 2017-003189 describes a heat exchanger in which an inlet region and an outlet region are provided at one side of a shell, a heat exchange region is provided in the central portion of the shell, and a reverse region for reversing the first fluid is provided at the other side of the shell.

In more detail, the heat exchanger described in Japanese Patent Laid-Open No. 2017-003189 includes an outbound tube for allowing the first fluid introduced into the inlet region to be directed to the reverse region, and an inbound tube for allowing the first fluid in the reverse region to be directed to the outlet region, and the inlet region and the outlet region are divided by a partition plate provided between the outbound tube and the inbound tube.

Such a configuration does not obviate a need to change the total number of tubes, compared to a configuration in which a first fluid introduced to one side of a shell is discharged from the other side of the shell, so that the number of introductions of the first fluid may be reduced and the flow rate of the first fluid may be increased, thereby improving the thermal conductivity.

On the other hand, according to another embodiment for improving the heat transfer rate, in order to increase the flow rate of a second fluid flowing outside a tube, a shell may be formed with a small inner diameter and tubes may be provided at narrow intervals (small diameter and high integration).

However, when the interval between the tubes is narrowed as such, the above described partition plate used for changing the direction of a first fluid is difficult to be provided between an outbound tube and an inbound tube.

Although the tubes may be arranged at a larger interval only at a portion where the partition plate is inserted, such a form may cause the shell to have a large diameter, and may cause drift when the second fluid is a two-phase refrigerant.

SUMMARY

Additional aspects will be set forth in part in the description which follows and, in part, will be apparent from the description, or may be learned by practice of the example embodiments.

A heat exchanger according to the disclosure includes a shell and a plurality of tubes disposed inside the shell. The shell includes a heat exchange region in which a second refrigerant (second fluid) is to be introduced into the shell, so that a heat exchange occurs between the second refrigerant and a first refrigerant (first fluid) which flows through the plurality of tubes. The shell also includes an inlet region disposed at one side of the heat exchange region, and through which the first refrigerant is introduced into the shell. The shell further includes a reverse region disposed at an other side of the heat exchange region, and into which the first refrigerant is introduced, after the first refrigerant passes through the heat exchange region along at least one of the plurality of tubes. The shell further includes an outlet region into which the first refrigerant is introduced, after the first refrigerant passes through the reverse region and is re-introduced into the heat exchange region, the first refrigerant being discharged out of the shell from the outlet region. The shell further includes a plurality of partition plates configured to divide the heat exchange region, the inlet region, the reverse region, and the outlet region According to the heat exchanger described herein, each of the plurality of tubes may be configured to pass through at least two partition plates among the plurality of partition plates. The plurality of tubes include an outbound tube through which the first refrigerant flows from the inlet region to the reverse region, and an inbound tube separated from the outbound tube, and through which the first refrigerant flows from the reverse region to the outlet region.

According to the heat exchanger configured as described above, since the partition plates are provided to allow the outbound tube and the inbound tube to pass therethrough, the arrangement of the partition plates does not hinder in reducing the inner diameter of the shell or narrowing the interval between the outbound tube and the inbound tube.

Therefore, because the first fluid may be redirected within the shell while achieving thinning of the shell and high integration of the tubes, the flow rates of the first fluid and the second fluid may be improved and the heat transfer rate may be remarkably improved compared to the related art.

When the outbound tube and the inbound tube are connected in a U-shape to form a single tube, a U-shaped tube subjected to various bending methods is required in order to achieve thinning of the shell and high integration of tubes, and the arrangement is also limited to prevent the tubes from interfering with each other, resulting in a decrease in manufacturability.

Therefore, in order to secure productivity, for example, the outbound tube and the inbound tube have different bodies, and are separate from each other.

In such a configuration, the manufacturability is ensured. In addition, the degree of freedom in design may be greatly improved, such as using tubes of different diameters for the outbound tube and the inbound tube. In addition, because the interval between the outbound tube and the inbound tube may be narrowed compared to the case of using a U-shaped tube, the flow rate of the second fluid may also be improved accordingly.

According to the heat exchanger described herein, one end of the outbound tube through which the first refrigerant is introduced into the outbound tube may be disposed in the inlet region, and an other end of the outbound tube through which the first refrigerant is discharged from the outbound tube may be disposed in the reverse region. One end of the inbound tube through which the first refrigerant is introduced into the inbound tube may be disposed in the reverse region, and an other end of the inbound tube through which the first refrigerant is discharged from the inbound tube may be disposed in the outlet region For example, the lengths of the outbound tube and the inbound tube may be different from each other.

In an example configuration, the inlet region and the outlet region may be set in regions deviated from the axial direction of the shell, and the regions may be divided by a partition plate through which the outbound tube and the inbound tube pass.

For example, the outlet region, the inlet region, and the reverse region may be sequentially arranged from one side of the shell to the other side of the shell. That is, according to the heat exchanger described herein, the heat exchange region, the inlet region, the reverse region, and the outlet region may be disposed in a lengthwise direction of the shell.

In such a configuration, because the inlet region allows not only the outbound tube connecting the inlet region and the reverse region but also the inbound tube connecting the reverse region and the outlet region to pass therethrough, the first fluid introduced into the inlet region comes in contact with the plurality of tubes, by which the flow is dispersed, resulting in an improved heat exchange efficiency.

As an example embodiment, the shell may have a heat exchange region through which the second fluid flows, and the heat exchange area may be divided by the partition plate from the inlet region, the reverse region, and the outlet region.

According to the heat exchanger described herein, the plurality of partition plates may include a first partition plate, a second partition plate, and a third partition plate. The outbound tube may be configured to pass through the first partition plate which divides the inlet region and the heat exchange region and the second partition plate which divides the heat exchange region and the reverse region. The inbound tube may be configured to pass through the first partition plate, the second partition plate, and the third partition plate which divides the outlet region and the inlet region. The outlet region may be disposed at one side end in a lengthwise direction of the shell, and the reverse region may be disposed at an other side end in the lengthwise direction of the shell.

According to the heat exchanger described herein, the shell may include an inlet port through which the first refrigerant is introduced into the inlet region and an outlet port through which the first refrigerant is discharged from the outlet region. The inlet port may be disposed on one side of the shell in a direction perpendicular to a lengthwise direction of the shell, and the outlet port may be disposed on an opposite side of the shell in the direction perpendicular to the lengthwise direction of the shell, and the outbound tube may be disposed closer to the inlet port than the inbound tube is, and the inbound tube is disposed closer to the outlet port than the outbound tube is.

According to the heat exchanger described herein, the shell may include an inlet port through which the first refrigerant is introduced into the inlet region and an outlet port through which the first refrigerant is discharged from the outlet region. The inlet port may be disposed on one side of the shell in a direction perpendicular to a lengthwise direction of the shell, and the outlet port may be disposed on an opposite side of the shell in the direction perpendicular to the lengthwise direction of the shell. The outbound tube may include a plurality of outbound tubes and the inbound tube may include a plurality of inbound tubes, and each of the plurality of outbound tubes may be partially disposed in the outlet region such that the plurality of outbound tubes extend in the lengthwise direction between a position adjacent to the inlet port to a position adjacent to the outlet port inside the shell, The first refrigerant may flow through the plurality of outbound tubes from the inlet region to the reverse region via the outlet region and the heat exchange region.

According to the heat exchanger described herein, the shell may include a first inlet port through which the first refrigerant is introduced into the inlet region, a first outlet port through which the first refrigerant is discharged from the outlet region, a second inlet port through which the second refrigerant is introduced into the heat exchange region, and a second outlet port through which the second refrigerant is discharged from the heat exchange region. The second inlet port may be disposed on one side of the shell in a direction perpendicular to a lengthwise direction of the shell, and the second outlet port may be disposed on an opposite side of the shell in the direction perpendicular to the lengthwise direction of the shell. The outbound tube may include a plurality of outbound tubes and the inbound tube may include a plurality of inbound tubes. The plurality of outbound tubes may be disposed in a central portion of the shell with respect to the direction perpendicular to the lengthwise direction of the shell, and the plurality of inbound tubes may be disposed closer to the second inlet port or the second outlet port than the plurality of outbound tubes are.

In order to improve the heat transfer rate of the heat exchange region, for example, a baffle may be provided in the heat exchange region to change the flow direction of the second fluid. When the second fluid is a low-temperature two-phase, dry-out may occur on the downstream side of the heat exchange region, and thus the heat transfer rate may be lowered.

According to an example, the baffle may be provided in plural in the heat exchange region, and the interval between the baffles adjacent to each other on the downstream side of the second fluid may be narrower than the interval between the baffles adjacent to each other on the upstream side of the second fluid. For example, the shell may include a plurality of baffles configured to change a flow direction of the second refrigerant flowing in the heat exchange region, and the plurality of baffles may be disposed in the heat exchange region and be spaced apart from each other in a lengthwise direction of the shell. For example, adjacent baffles among the plurality of baffles may be disposed at a downstream side of the second refrigerant and be spaced apart from each other by a first interval, and adjacent baffles among the plurality of baffles may be disposed at an upstream side of the second refrigerant and be spaced apart from each other by a second interval, the second interval being greater than the first interval.

In this case, the flow rate of the second fluid on the downstream side of the heat exchange region may be further increased, thereby suppressing a decrease in the heat transfer rate due to dry-out.

In order to further improve the heat transfer rate of the heat exchange region, for example, an enlarged heat transfer surface may be provided on the outer surface of the tube in the heat exchange region.

For example, the enlarged heat transfer surface may be provided in a plurality of units in the heat exchange region, and the interval between the enlarged heat transfer surfaces adjacent to each other on the downstream side of the second fluid may be narrower than the interval between the enlarged heat transfer surfaces adjacent to each other on the upstream side of the second fluid. For example, the plurality of tubes may include a plurality of heat transfer surfaces radially extending from outer circumferential surfaces of the plurality of tubes, and the plurality of heat transfer surfaces may be disposed on portions of the plurality of tubes which are disposed in the heat exchange region. For example, adjacent heat transfer surfaces among the plurality of heat transfer surfaces may be disposed at a downstream side of the second refrigerant and be spaced apart from each other by a first interval, and adjacent heat transfer surfaces among the plurality of heat transfer surfaces may be disposed at an upstream side of the second refrigerant and be spaced apart from each other by a second interval, the second interval being greater than the first interval.

In this case, as described above, the flow rate of the second fluid may be increased on the downstream side in which dry-out may occur, thereby suppressing a decrease in heat transfer rate due to dry-out.

For example, a baffle may be provided between the tubes adjacent to each other in the heat exchange region. According to an example, the shell may include a baffle configured to change a flow direction of the second refrigerant flowing in the heat exchange region, and the baffle may be disposed in the heat exchange region between adjacent tubes among the plurality of tubes and extend in a lengthwise direction of the shell.

In this case, since an outbound and inbound may be formed with respect to the second fluid flowing through the heat exchange region in the shell, the flow rate of the second fluid may be increased, so that heat transfer between the first fluid and the second fluid may be promoted.

For example, a concave portion or a convex portion may be formed on the inner surface of the tube.

In this case, the heat transfer area of the inner peripheral surface of the tube may be expanded and the turbulence of the first fluid flowing in the tube may be promoted, so that the amount of heat exchange may be increased.

In addition, the air conditioner according to the disclosure may include the above-described heat exchanger, and the air conditioner may provide the same effect as that of the above-described heat exchanger. For example, the air conditioner may include a refrigerant circuit in which a compressor, an outdoor heat exchanger, an expansion mechanism, and an indoor heat exchanger are connected. The heat exchanger described herein may be used for at least one of the outdoor heat exchanger or the indoor heat exchanger.

DETAILED DESCRIPTION

Figure 1:
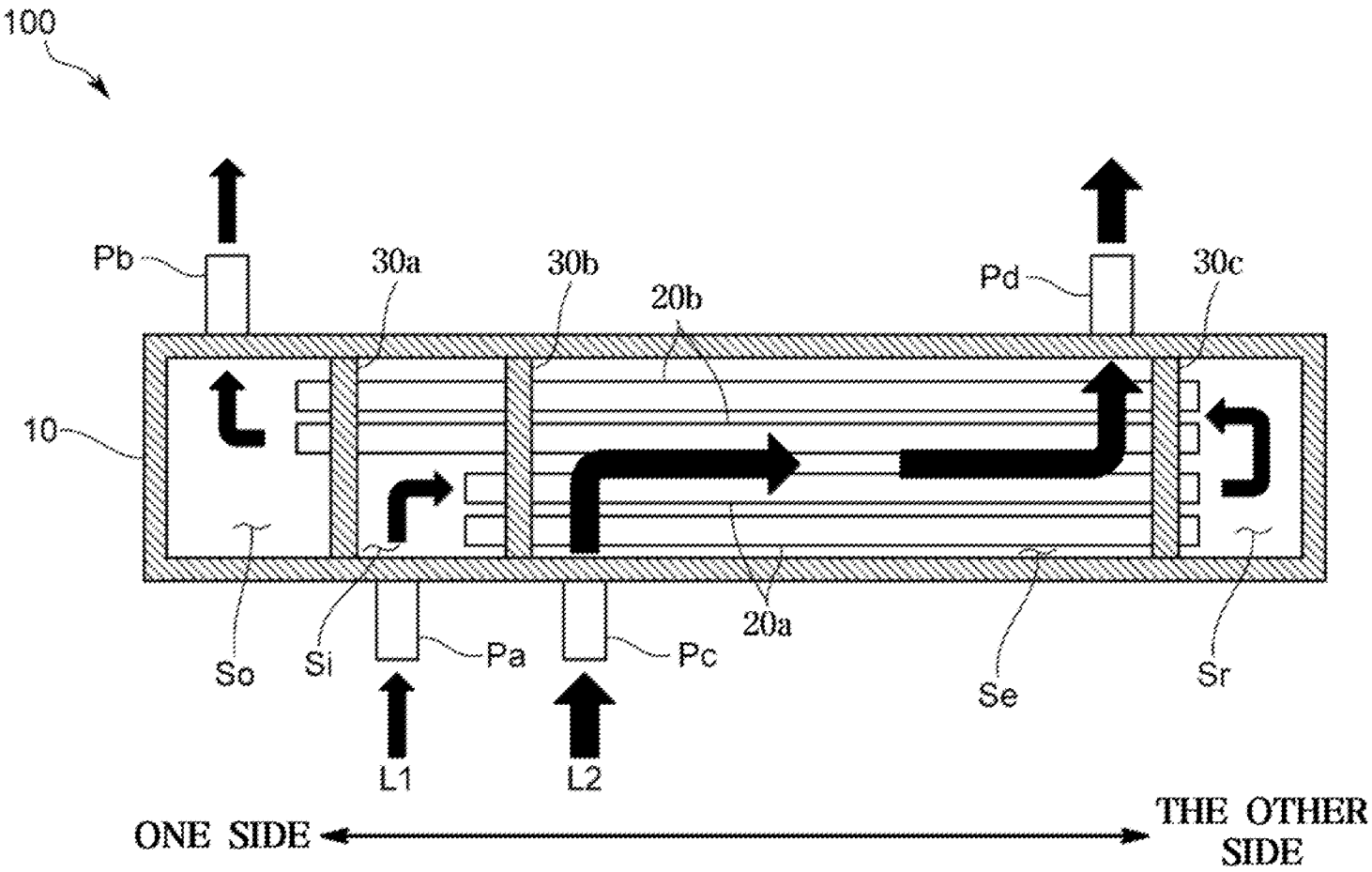
FIG. 1 is a schematic diagram illustrating an internal configuration of a heat exchanger according to an embodiment of the disclosure.

Configurations illustrated in the embodiments and the drawings described in the specification are example embodiments of the disclosure, and thus it is to be understood that various modified examples, which may replace the embodiments and the drawings described in the specification, are possible.

Also, like reference numerals or symbols denoted in the drawings of the specification represent members or components that perform substantially the same functions.

The terms used in the specification are used to describe the embodiments, and are not intended to limit and/or restrict the disclosure. It is to be understood that the singular forms "a," "an," and "the" include plural referents unless the context clearly dictates otherwise. It will be understood that the terms "includes," "comprises," "including," and/or "comprising," when used in the specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., used in the specification may be used to describe various components, these components should not be limited by these terms. These terms are used to distinguish one component from another. For example, a first component could be termed a second component, and, similarly, a second component could be termed a first component, without departing from the scope of the disclosure.

When it is stated in the disclosure that one element is "connected to" or "coupled to" another element, the expression encompasses an example of a direct connection or direct coupling, as well as a connection or coupling with another element interposed therebetween.

Meanwhile, in the following description, the terms "front", "rear", "left", and "right" are defined based on the drawings, and the shapes and positions of the components are not limited by the terms.

The scope of the expression or phrase of "and/or" includes a plurality of combinations of relevant items or any one item among a plurality of relevant items. For example, the scope of the expression or phrase "A and/or B" includes all of the following: (1) the item "A", (2) the item "B", and (3) the combination of items "A and B".

In addition, the scope of the expression or phrase "at least one of A and B" is intended to include all of the following: (1) at least one of A, (2) at least one of B, and (3) at least one A and at least one of B. Likewise, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

One or more aspects of the disclosure address the above-described problems discussed with respect to the related art, and one or more aspects of the disclosure including changing the direction of a first fluid in a shell while reducing the inner diameter of a shell and narrowing the interval between tubes.

According to example embodiments of the heat exchanger described herein, the direction of a first fluid can be changed in a shell even with a small inner diameter of a shell and a narrow interval between tubes, and can increase the flow rates of a first fluid and a second fluid, thereby remarkably increasing the heat transfer rate compared with the related art.

Hereinafter, an embodiment of a heat exchanger according to the disclosure will be described with reference to the drawings.

In an air conditioner having a refrigerant circuit in which a compressor, an outdoor heat exchanger, an expansion mechanism, and an indoor heat exchanger are connected, the heat exchanger described herein is used for at least one of the outdoor heat exchanger or the indoor heat exchanger.

Specifically, the heat exchanger 100 is a so-called shell-and-tube heat exchanger as shown in FIG. 1 including a shell 10 and a plurality of tubes 20 provided in the shell 10, and heat exchange is performed between a first fluid L1 flowing inside the tube 20 and a second fluid L2 flowing outside the tube 20 in the shell 10.

As shown in FIG. 1, the heat exchanger 100 according to the example embodiment is configured such that the first fluid L1 changes the direction at least one time inside the shell 10, that is, such that the first fluid L1 introduced from one side of the shell 10 is guided to the other side of the shell 10 and then guided to the one side of the shell 10 again.

The shell 10 has a cylindrical shape, and as shown in FIG. 1, is provided with an inlet region Si through which the first fluid L1 is introduced, an outlet region So through which the first fluid L1 is discharged, and a heat exchange region Se in which heat exchange is performed between the first fluid L1 and a second fluid L2 while the second fluid L2 enters and leaves the exchange region Se in an internal space of the shell 10.

The inlet region Si is set on one side in the axial direction of the shell 10, and a first inlet port Pa is provided for the first fluid L1 to be introduced into the inlet region Si.

The outlet region So is set on the one side of the axial direction of the shell 10, and a first outlet port Pb is provided for the first fluid L1 to be discharged from the outlet region So.

In the example embodiment, the inlet region Si and the outlet region So are provided adjacent to each other, and in this case, the outlet region So is provided at an area outside (one side in the axial direction) the inlet region Si. However, the outlet region So may be provided at an area inside (the other side in the axial direction) the inlet region Si.

In addition, the first inlet port Pa and the first outlet port Pb are arranged with the axis of the shell 10 interposed therebetween and are opened in opposite directions. However, the first inlet port Pa and the first outlet port Pb do not need to be opened in opposite directions, and the arrangement may be properly changed, such as being opened in directions perpendicular to each other.

The heat exchange region Se is set on the central portion in the axial direction of the shell 10, and is provided with a second inlet port Pc for introducing the second fluid L2 into the heat exchange region Se, and a second outlet port Pd for discharging the second fluid L2 from the heat exchange region Se.

The second inlet port Pc and the second outlet port Pd are arranged with the axis of the shell 10 interposed therebetween and are formed through the outer surface of the shell 10 to be opened in opposite directions. Here, in the example embodiment, the second inlet port Pc is opened in the same direction as the first inlet port Pa, and the second outlet port Pd is opened in the same direction as the first outlet port Pb. However, the second inlet port Pc and the second outlet port Pd do not need to be opened in opposite directions, and the arrangement may be properly changed, such as being opened in directions perpendicular to each other.

In addition, one sides of the second inlet port Pc and the second outlet port Pd are provided on one side in the axial direction of the heat exchange region Se, and the other sides of the second inlet port Pc and the second outlet port Pd are provided on the other side in the axial direction of the heat exchange region Se. With such an arrangement, the second fluid L2 introduced from the second inlet port Pc flows along the axial direction of the shell 10, heat-exchanging with the first fluid L1 flowing inside the tube 20 (which will be described below) to exit through the second outlet port Pd.

In addition, in the inner space of the shell 10 according to the example embodiment, a reverse region Sr is set on the other side in the axial direction and configured to change the direction of the first fluid L1.

Here, one reverse region Sr is provided in the inner space of the shell 10, and the reverse region Sr is disposed at an area outside (the other side in the axial direction) the heat exchange region Se and adjacent to the heat exchange region Se.

The plurality of tubes 20 allow the first fluid L1 to flow therethrough, and the tubes 20 include at least an outbound tube 20*a* for guiding the first fluid L1 from the inlet region Si to the reverse region Sr and an inbound tube 20*b* for guiding the first fluid L1 from the reverse region Sr to the outlet region So. In this case, a plurality of the outbound tubes 20*a* are arranged at a side of the first inlet port Pa or the second inlet port Pc, and a plurality of the inbound tubes 20*b* are arranged at a side of the first outlet port Pb or the second outlet port Pd.

The outbound tube 20*a* extends along the axial direction of the shell 10 and is arranged so that an upstream opening thereof is located on the inlet region Si and a downstream opening thereof is located on the reverse region Sr. That is, the outbound tube 20*a* spans the inlet region Si, the heat exchange region Se, and the reverse region Sr, wherein the plurality of outbound tubes 20*a* are provided parallel to the axial direction of the shell 10. However, the number of the outbound tubes 20*a* may be properly changed, and the extending direction of the outbound tube 20*a* may be inclined with respect to the axial direction of the shell 10.

The inbound tube 20*b* has a body separated from that of the outbound tube 20*a* and extends along the axial direction of the shell 10, and has an upstream opening located in the reverse region Sr, and a downstream opening located in the outlet region So. That is, the inbound tube 20*b* spans the reverse region Sr, the heat exchange region Se, and the outlet region So. The plurality of inbound tubes 20*b* are illustrated as being parallel to the axial direction of the shell 10. However, the number of inbound tubes 20*b* may be properly changed, and the extending direction of the inbound tube 20*b* may be inclined with respect to the axial direction of the shell 10.

The outbound tube 20*a* and the inbound tube 20*b* described above have different lengths, and the inbound tube 20*b* is illustrated as being longer than the outbound tube 20*a*.

As shown in FIG. 1, the heat exchanger 100 according to the embodiment further includes a partition plate 30 provided in the shell 10 and configured to divide the inlet region Si, the reverse region Sr, and the outlet region So, while allowing at least the outbound tube 20*a* or the inbound tube 20*b* to pass therethrough.

The partition plate 30 divides regions adjacent to each other among the inlet region Si, the outlet region So, the heat exchange region Se, and the reverse region Sr, and in the example embodiment, includes a first partition plate 30*a* dividing the outlet region So and the inlet region Si, a second partition plate 30*b* dividing the inlet region Si and the heat exchange region Se, and a third partition plates 30*c* dividing the heat exchange region Se and the reverse region Sr.

The partition plate 30 according to the example embodiment is provided to be perpendicular to the axial direction of the shell 10, and is provided to be perpendicular to the outbound tube 20*a* or the inbound tube 20*b*.

The first partition plate 30*a* allows the inbound tube 20*b* to pass therethrough, and is provided to be perpendicular to the inbound tube 20*b*, that is, to be perpendicular to the axis of the shell 10.

The second partition plate 30*b* allows the outbound tube 20*a* and the inbound tube 20*b* to pass therethrough, and is provided to be perpendicular to the outbound tube 20*a* or the inbound tube 20*b*, that is, to be perpendicular to the axis of the shell 10.

The third partition plate 30*c* allows the outbound tube 20*a* and the inbound tube 20*b* to pass therethrough, and is provided to be perpendicular to the outbound tube 20*a* or the inbound tube 20*b*, that is to be perpendicular to the axis of the shell 10.

Figure 2:
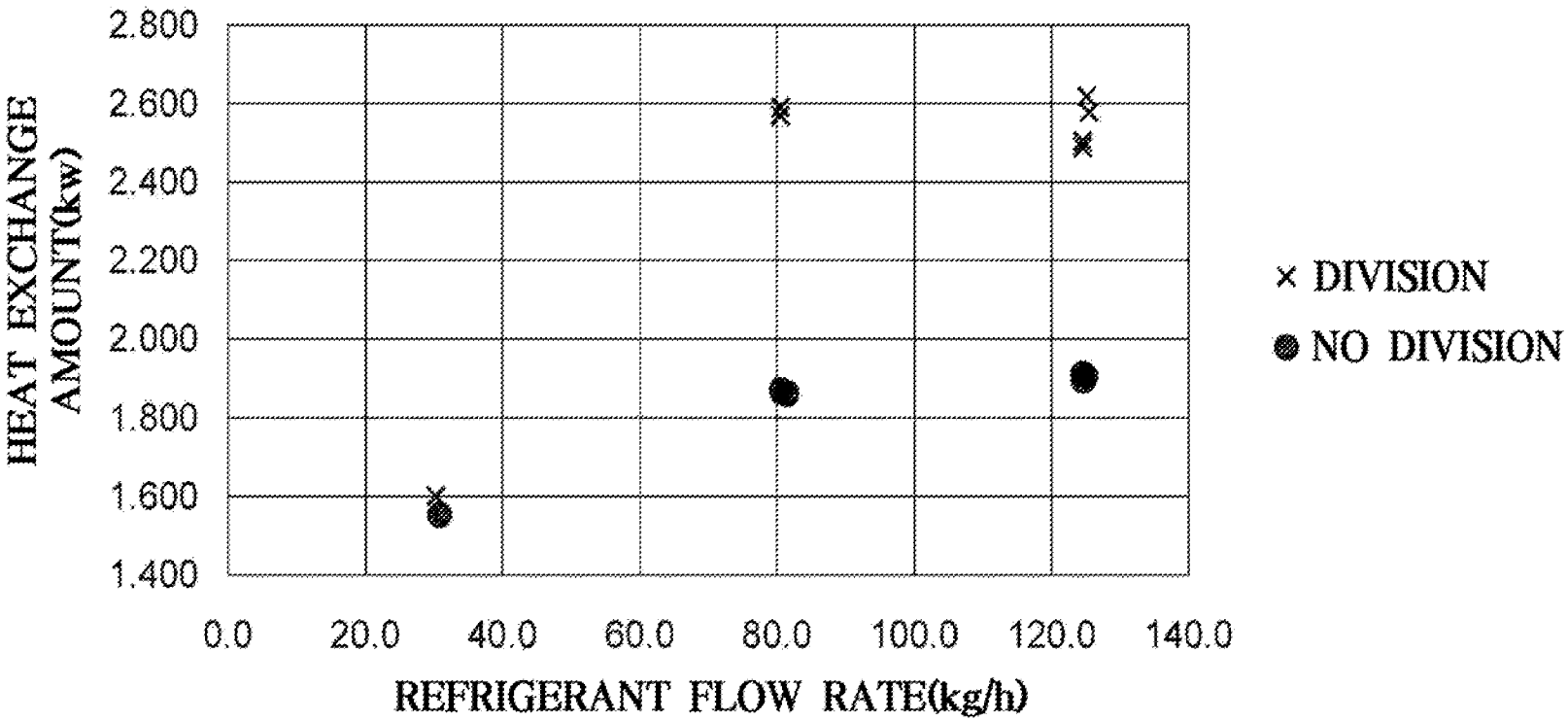
FIG. 2 is experimental data showing the effect of a heat exchanger according to an embodiment.

Here, the experimental result shown in FIG. 2 is a result obtained by comparing the amount of heat exchange of the heat exchanger 100 according to the embodiment with that of the heat exchanger according to a related art configuration.

It can be seen from the experimental result that the heat exchanger 100 according to the example embodiment in which the inlet region Si, the outlet region So, the heat exchange region Se, and the reverse region Sr are divided by the partition plate 30 has a larger amount of heat exchange compared to the related art configuration in which the partition plate 30 is not used.

As such, in the heat exchanger 100 according to the example embodiment, the partition plate 30 is provided to allow the outbound tube 20*a* or the inbound tube 20*b* to pass therethrough, so that the arrangement of the partition plate 30 does not interfere with reducing the inner diameter of the shell 10 or narrowing the interval between the outbound tube 20*a* and the inbound tube 20*b*.

Therefore, because the first fluid L1 may be redirected within the shell 10 while achieving thinning of the shell 10 and high integration of the tubes 20, the flow rates of the first fluid L1 and the second fluid L2 may be improved and the heat transfer rate may be remarkably improved compared to the related art.

In addition, because the partition plate 30 is provided to allow the outbound tube 20*a* or the inbound tube 20*b* to pass therethrough, the arrangement of the outbound tube 20*a* and the inbound tube 20*b*, the number and arrangement of the reverse regions Sr, and the arrangement of the inlet region Si and the outlet region So may take various forms as will be described below, and thus the degree of freedom of arrangement may be improved compared to the related art configuration.

In addition, because the outbound tube 20*a* and the inbound tube 20*b* are provided as separate bodies from each other, the manufacturability is excellent compared to the case of using a U-shaped integral tube. Furthermore, for example, the degree of freedom in design may be greatly improved, such as using tubes of different diameters as the outbound tube 20*a* and the inbound tube 20*b*. In addition, because the interval between the outbound tube 20*a* and the inbound tube 20*b* may be narrowed compared to the case of using a U-shaped tube, the flow rate of the second fluid L2 may be improved accordingly.

Furthermore, the outlet region So, the inlet region Si, and the reverse region Sr are sequentially arranged from one side of the shell 10 toward the other side of the shell 10, and the inlet region Si has not only the outbound tube 20*a* but also the inbound tube 20*b* pass therethrough, so that the first fluid L1 introduced into the inlet region Si may come in contact with the plurality of tubes 20 so that the flow is dispersed, thereby improving the heat exchange efficiency.

Here, the disclosure is not limited to the above embodiment.

Figure 3:
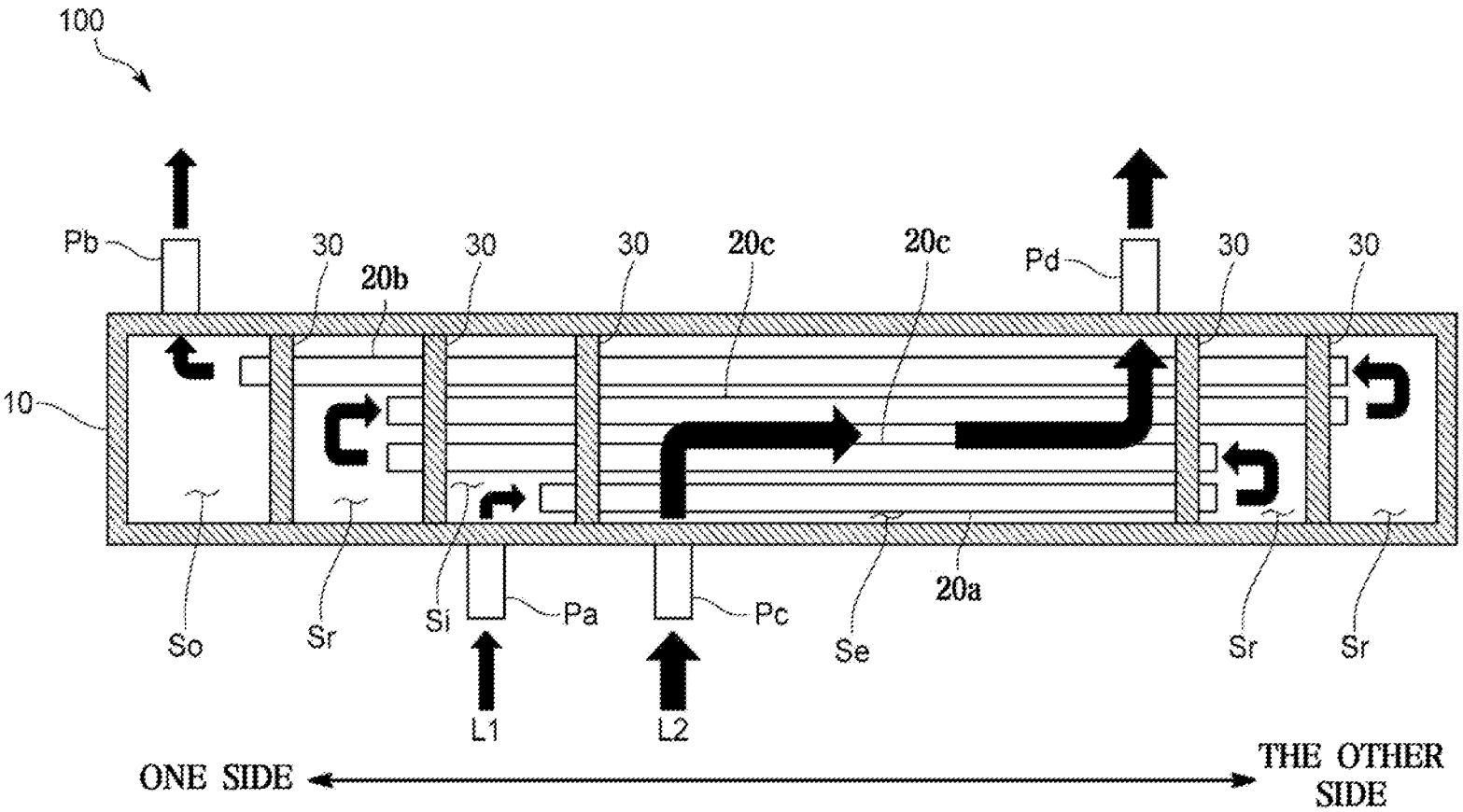
FIG. 3 is a schematic diagram illustrating an internal configuration of a heat exchanger according to an embodiment of the disclosure.

For example, one reverse region Sr is provided in the inner space of the shell 10 in the above embodiment, but as shown in FIG. 3, a plurality of reverse regions Sr may be provided in the inner space of the shell 10.

In more detail, the tubes 20 of the heat exchanger 100 may include not only the outbound tube 20*a* and the inbound tube 20*b* but also an intermediate tube 20*c* for guiding the first fluid L1 from one reverse region Sr to another reverse region Sr. As illustrated in FIG. 3, a length of the plurality of tubes 20 may differ from one another, such that a length of outbound tube 20*a* is shorter than a length of the intermediate tubes 20*c*, and the length of the intermediate tubes 20*c* may be less than a length of the inbound tube 20*b*. In addition, the intermediate tubes 20*c* may have different lengths from each other.

With such a configuration, the number of tubes 20 through which the first refrigerant introduced into the inlet region Si flows may be further reduced, so that the flow rate of the first fluid L1 may be further improved.

Figure 4:
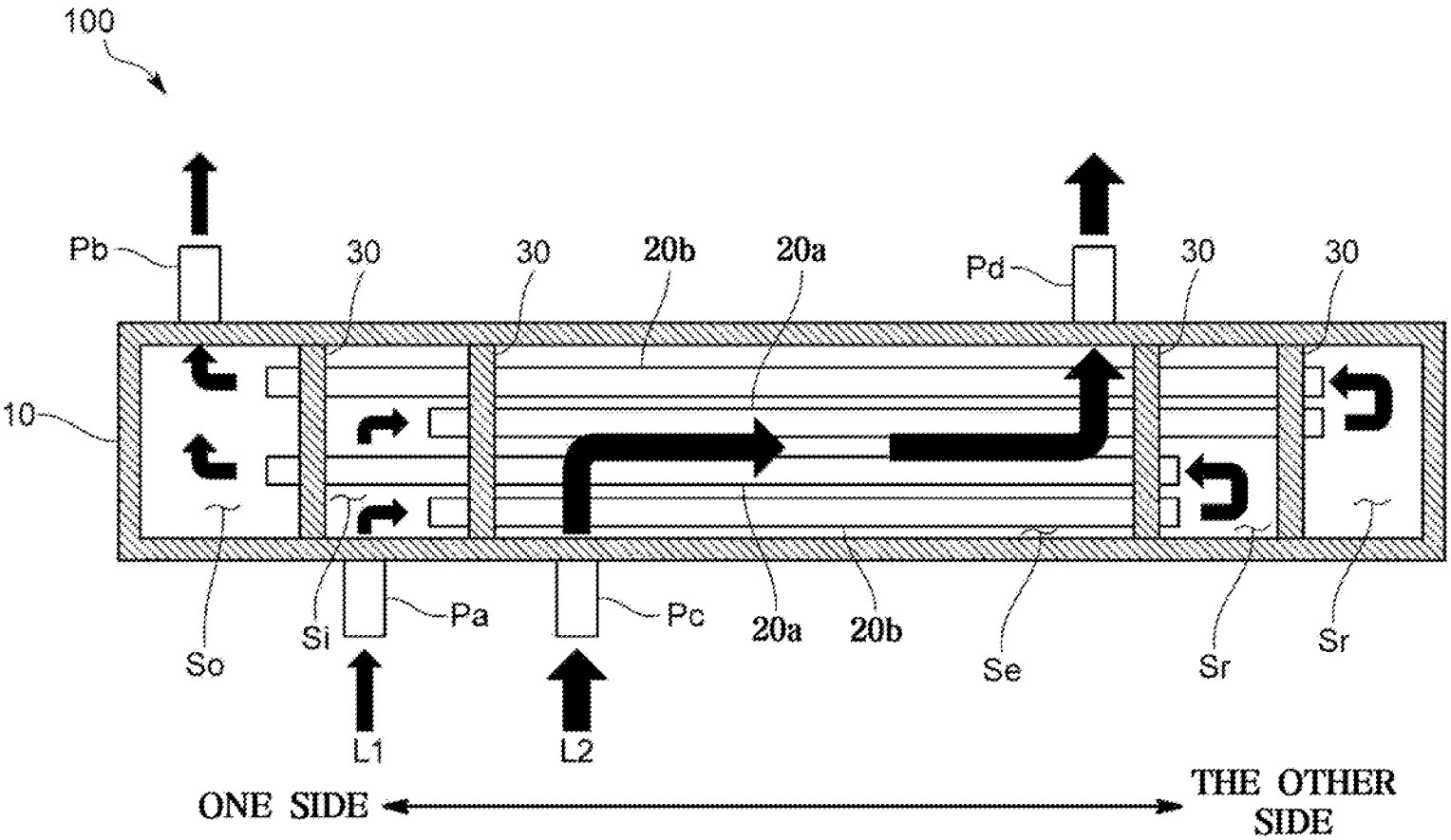
FIG. 4 is a schematic diagram illustrating an internal configuration of a heat exchanger according to an embodiment of the disclosure.

In addition, in the embodiment, the plurality of outbound tubes 20*a* are arranged at a side adjacent to the first inlet port Pa or the second inlet port Pc, and the plurality of inbound tubes 20*b* are arranged at a side adjacent to first outlet port Pb or the second outlet port Pd, but as shown in FIG. 4, the outbound tube 20*a* and the inbound tube 20*b* may be alternately arranged from a side adjacent to the first inlet port Pa or the second inlet port Pc to a side adjacent to the first outlet port Pb or the second outlet port Pb.

Here, when the second fluid L2 is a low-temperature two-phase fluid, a high-density liquid phase flows through an outer portion in the shell 10, and a low-density gas phase flows through the central portion in the shell 10.

Figure 5:
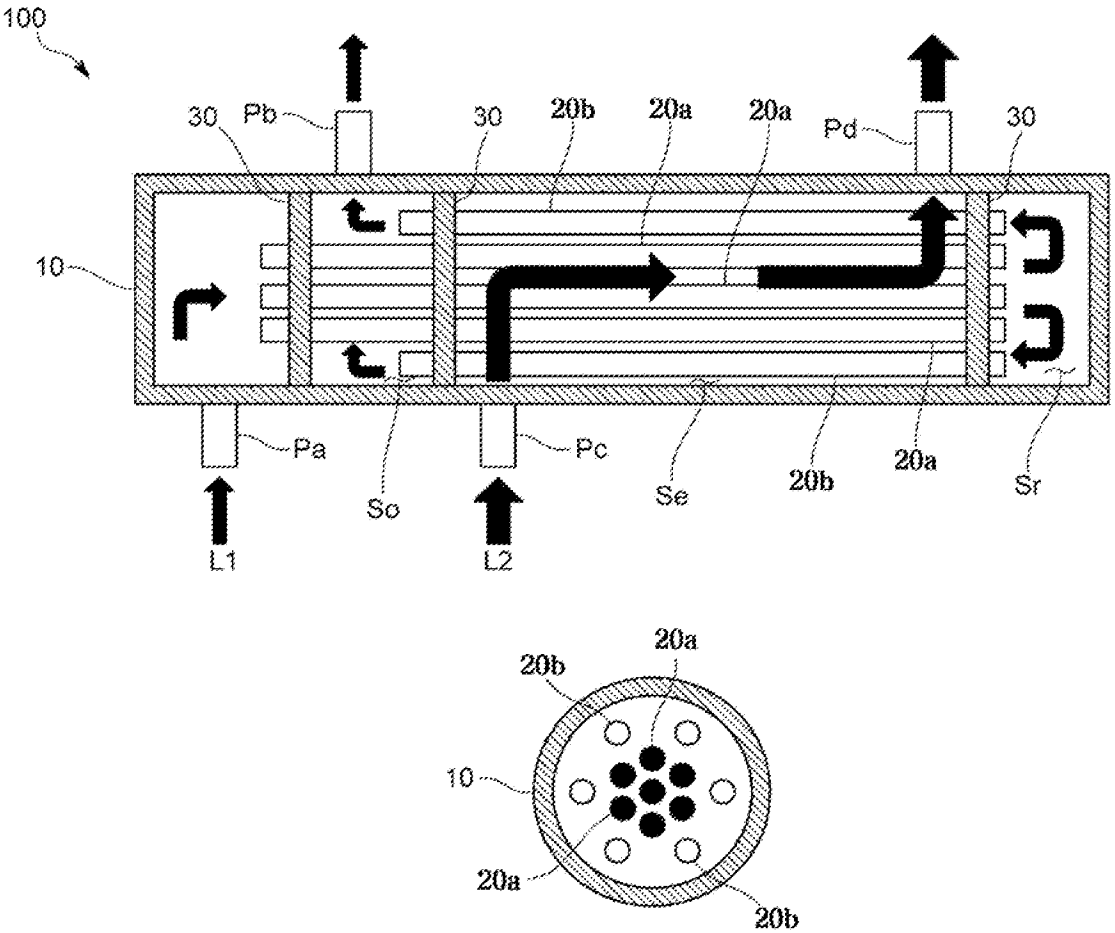
FIG. 5 is a schematic diagram illustrating an internal configuration of a heat exchanger according to an embodiment of the disclosure.

Therefore, in order to increase the amount of heat exchange in the gas phase, which has a low heat conduction, the plurality of outbound tubes 20*a* may be located in the central portion in the shell 10, and the plurality of inbound tubes 20*b* may be arranged at an area outside the outbound tubes 20*a* in the shell 10 as shown in FIG. 5.

With such a configuration, the outbound tube 20*a* is arranged in the central portion in the shell 10, so that the temperature difference between the gas phase of the second fluid L2 and the first fluid L1 flowing inside the outbound tube 20*a* is ensured so that the amount of heat exchange of the gas phase may be increased. Such an effect is exhibited particularly when the ratio of the gas phase contained in the second fluid L2 of the low-temperature two-phase is high.

Figure 6:
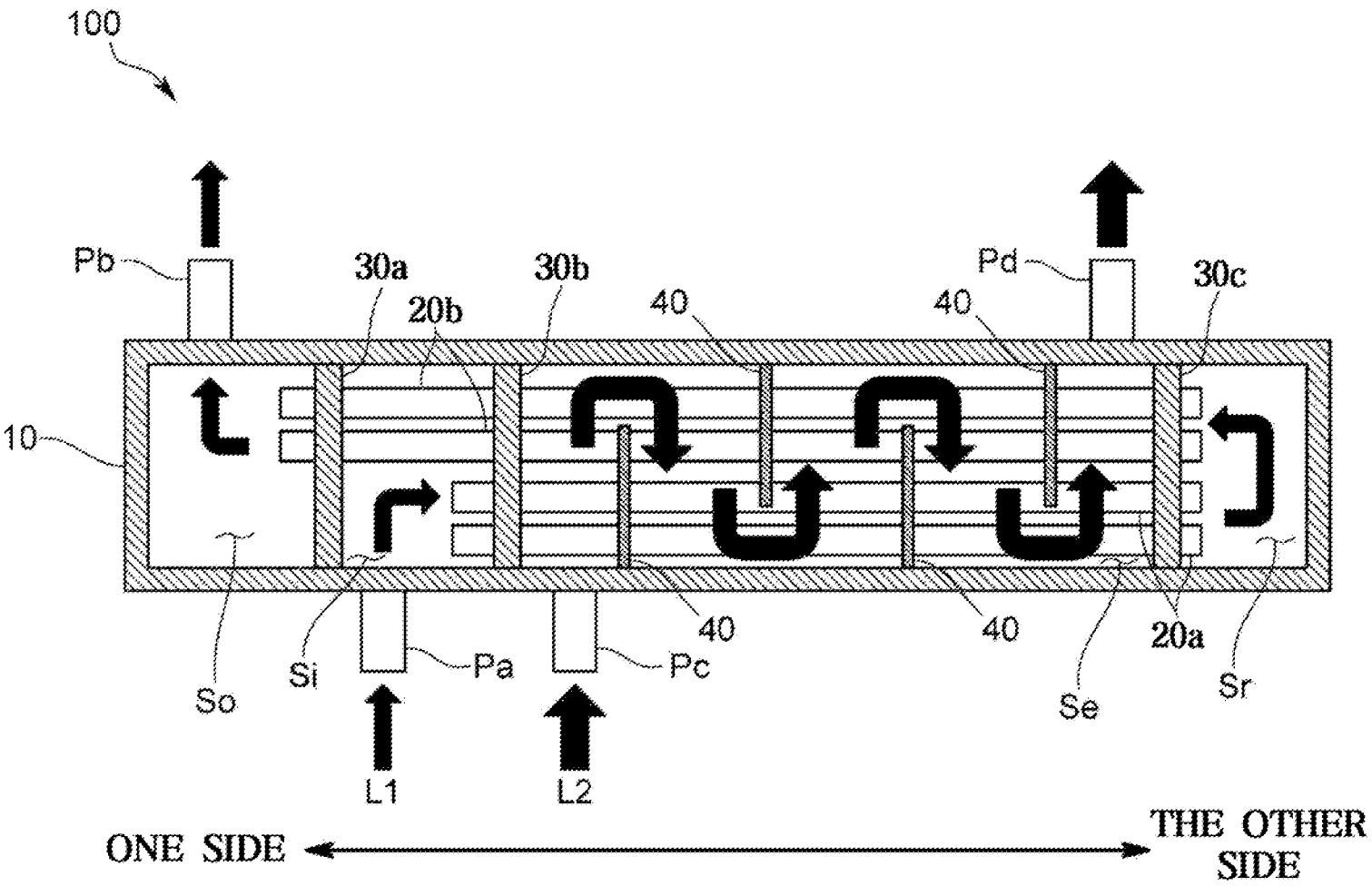
FIG. 6 is a schematic diagram illustrating a baffle according to an embodiment of the disclosure.

In addition, the heat exchanger 100 according to the disclosure may include a baffle 40 that is provided in the heat exchange region Se to change the flow direction of the second fluid L2 as shown in FIG. 6.

The baffle 40 prevents the flow of the second fluid L2 moving from the second inlet port Pc to the second outlet port Pd. Here, the plurality of baffles 40 are arranged in a zigzag form from the second inlet port Pc to the second outlet port Pd, so that the second fluid L2 is caused to flow while meandering from the second inlet port Pc toward the second outlet port Pd.

In such a configuration, the flow path of the second fluid L2 in the heat exchange region Se may be lengthened, so that the heat transfer rate of the heat exchange region Se may be further improved.

However, when the second fluid L2 is a low-temperature two-phase fluid, dry-out may occur on the downstream side of the heat exchange region Se, so that the heat transfer rate may be lowered.

Figure 7:
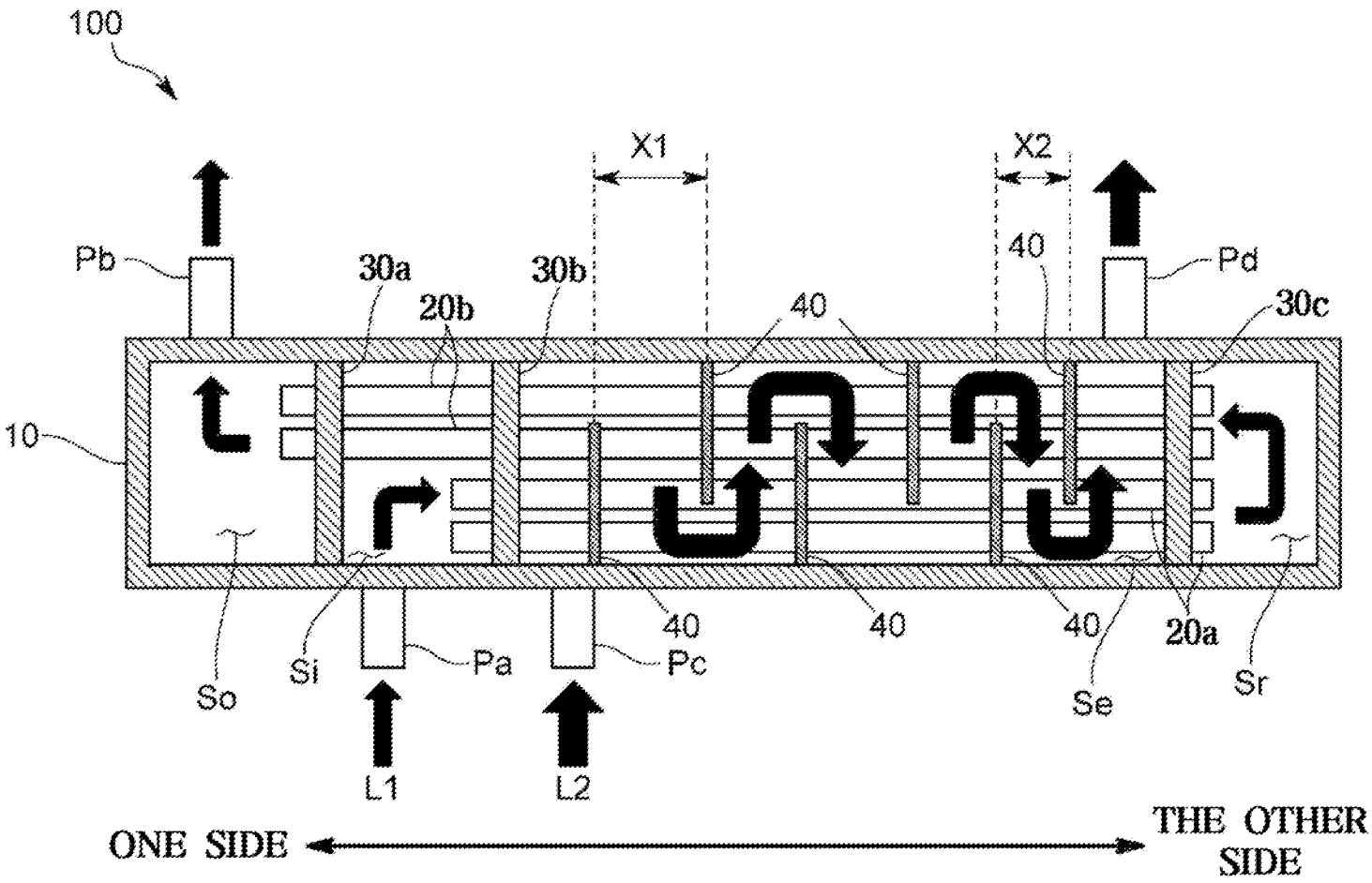
FIG. 7 is a schematic diagram illustrating a baffle according to an embodiment of the disclosure.

Therefore, in the configuration in which the plurality of baffles 40 are provided as described above, the interval X2 between the baffles 40 adjacent to each other on the downstream side of the second fluid L2 (the downstream side being closer to the "other side" than the "one side") may be set to be narrower than the interval X1 between the baffles 40 adjacent to each other on the upstream side of the L2 (the upstream side being closer to the "one side" than the "other side") as shown in FIG. 7.

In such a configuration, the flow rate of the second fluid L2 on the downstream side of the heat exchange region Se may be further increased, so that decrease of the heat transfer rate due to dry-out may be suppressed.

Figure 8:
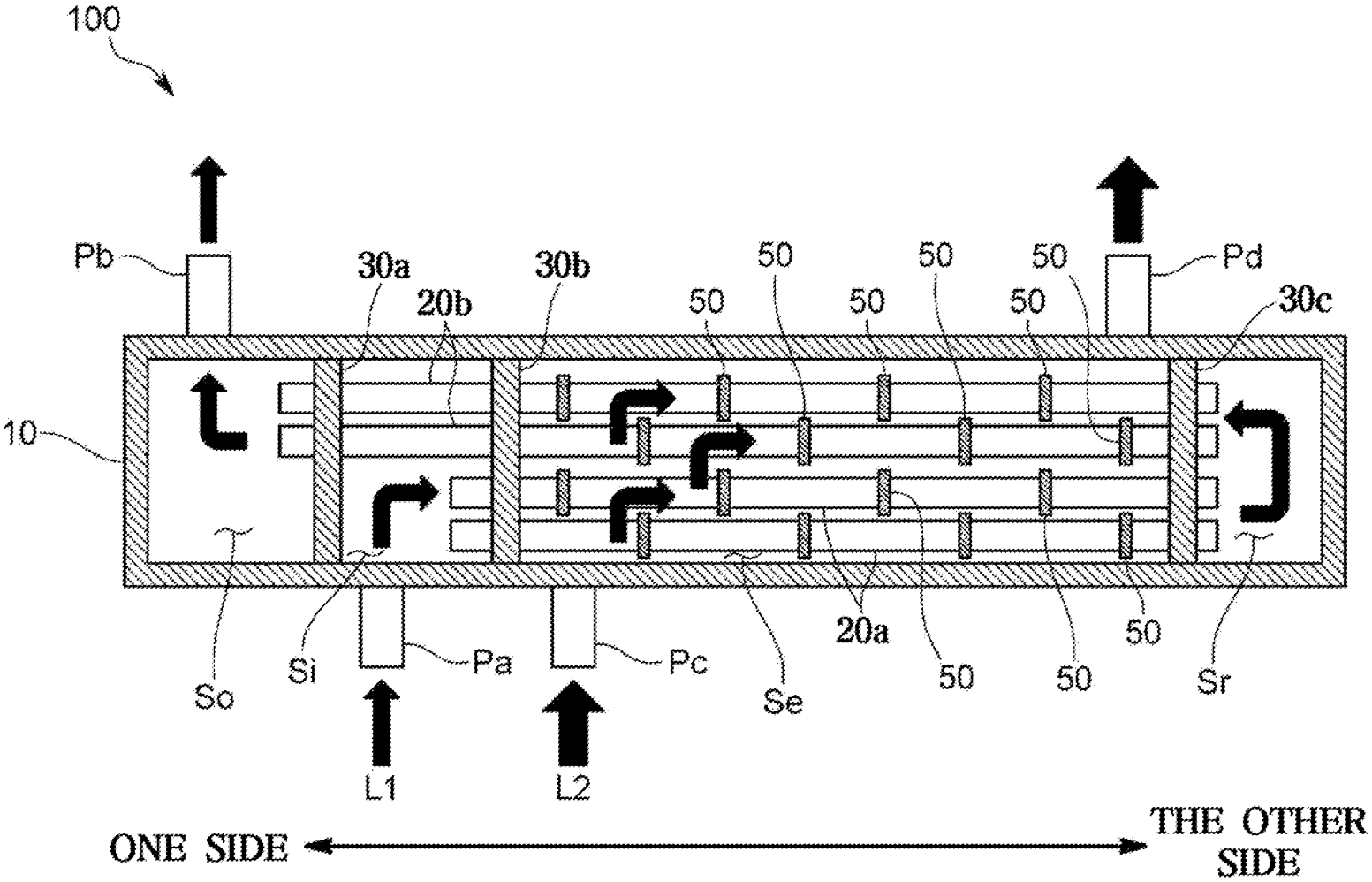
FIG. 8 is a schematic diagram illustrating an enlarged heat transfer surface according to an embodiment of the disclosure.

In addition, as shown in FIG. 8, the heat exchanger 100 according to the disclosure may include an enlarged heat transfer surface 50 provided on an outer surface of the tube 20 in the heat exchange region Se.

The enlarged heat transfer surface 50 is formed by fins provided on the outer peripheral surfaces of the outbound tube 20*a* and the inbound tube 20*b*, and a plurality of fins are formed lengthwise along the outbound tube 20*a* and the inbound tube 20*b*.

In such a configuration, the enlarged heat transfer surface 50 is provided on the outbound tube 20*a* and the inbound tube 20*b*, so that the heat transfer rate of the heat exchange region Se may be further improved.

Figure 9:
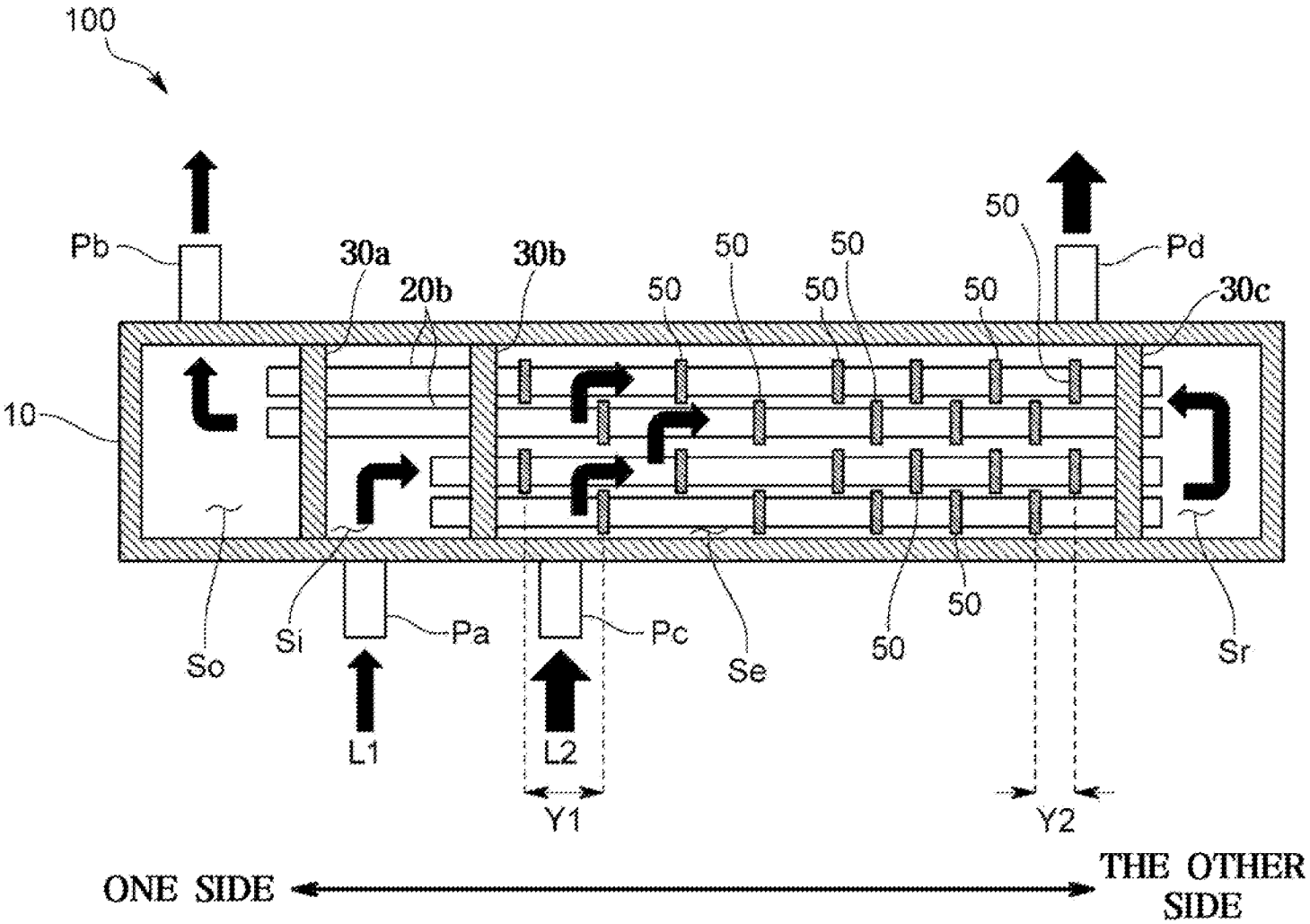
FIG. 9 is a schematic diagram illustrating an enlarged heat transfer surface according to an embodiment of the disclosure.

In the configuration having the fin that serves as the enlarged heat transfer surface 50 as described above, a plurality of the enlarged heat transfer surfaces 50 are provided in the heat exchange region Se as shown in FIG. 9, and an interval Y2 between the enlarged heat transfer surfaces 50 adjacent to each other on the downstream side of the second fluid L2 may be set to be narrower than an interval Y1 between the enlarged heat transfer surfaces 50 adjacent to each other on the upstream side of the second fluid L2.

In such a configuration as described above, the flow rate of the second fluid L2 may be increased on the downstream side in which dry-out may occur, so that a decrease of the heat transfer rate due to dry-out may be suppressed.

Figure 10:
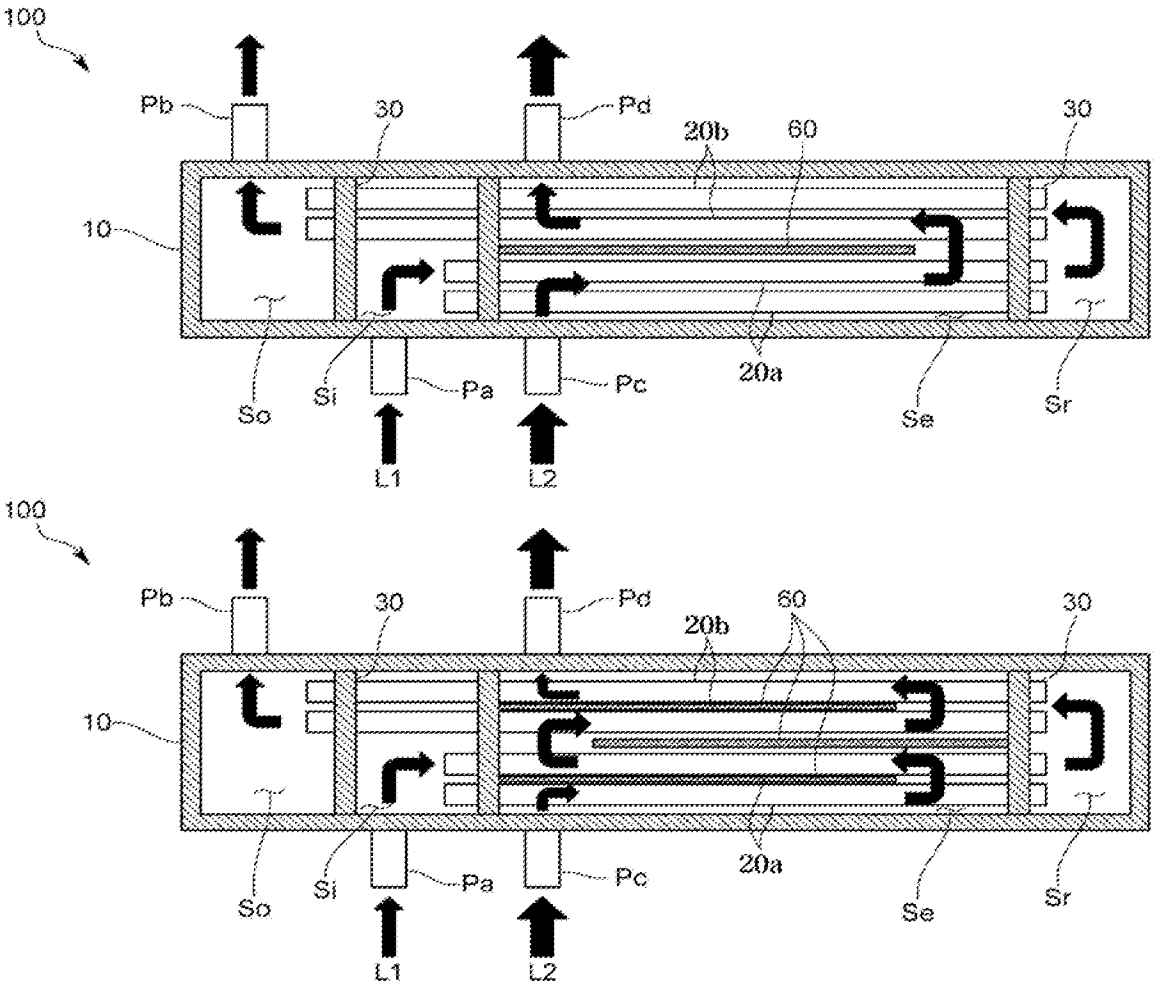
FIG. 10 is a schematic diagram illustrating a second baffle according to an embodiment of the disclosure.

In addition, as shown in FIG. 10, the heat exchanger 100 according to the disclosure may be provided with a second baffle 60 provided between the tubes 20 adjacent to each other in the heat exchange region Se.

The second baffle 60 may have a flat panel shape extending in parallel with the outbound tube 20*a* and the inbound tube 20*b*, and may be provided between the outbound tube 20*a* and the inbound tube 20*b* as shown in the upper part of FIG. 10, or may be provided between the outbound tubes 20*a* or between the inbound tubes 20*b* as shown in the lower part of FIG. 10. Here, in the example embodiment, the second inlet port Pc and the second outlet port Pd are illustrated as being arranged to be opposite to each other, but the arrangement of the second inlet port Pc and the second outlet port Pd is not limited thereto, and may be properly changed.

In such configuration, the second fluid L2 flows while meandering from the second inlet port Pc to the second outlet port Pd, so that the flow path of the second fluid L2 in the heat exchange region Se is lengthened. Therefore, the heat transfer rate of the heat exchange region Se may be further improved.

Figure 11:
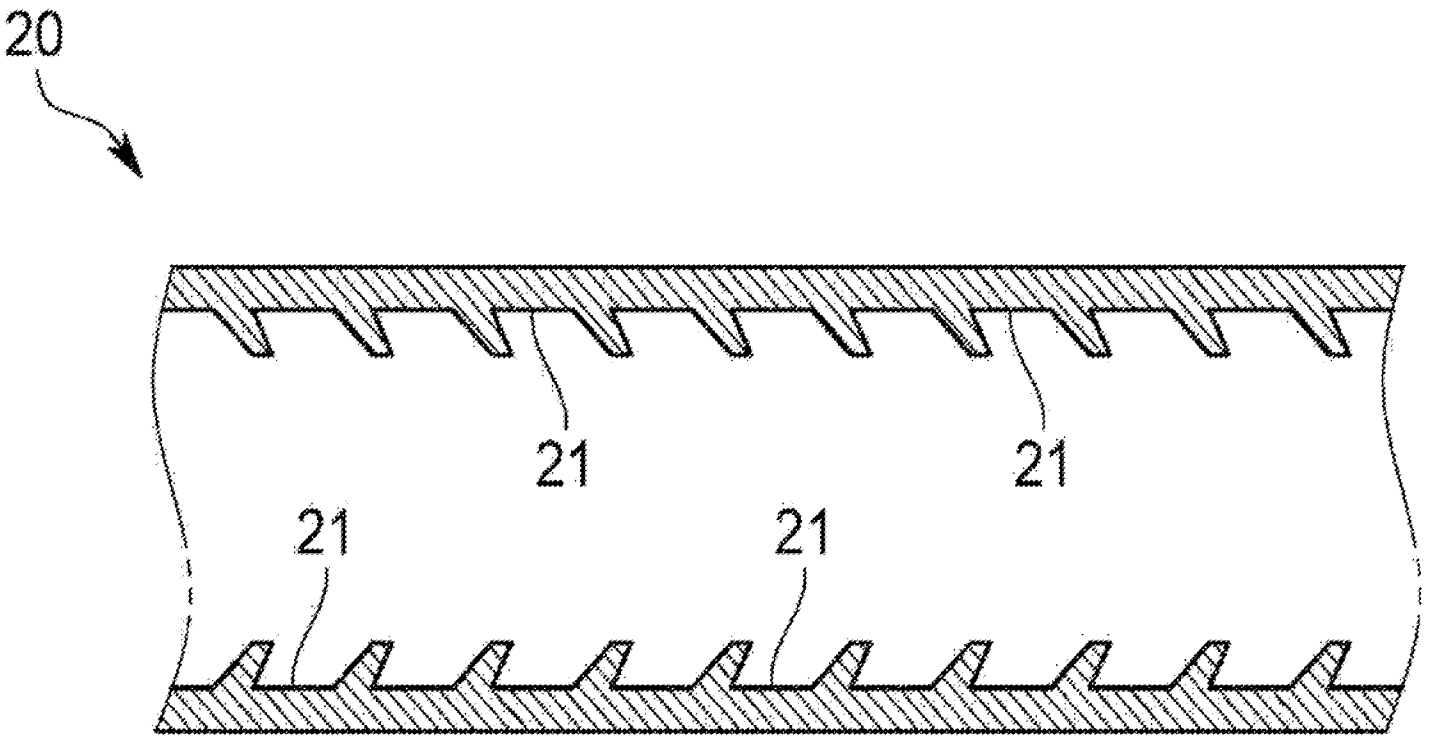
FIG. 11 is a schematic view illustrating the structure of an inner peripheral surface of a tube according to an embodiment of the disclosure.

In addition, as shown in FIG. 11, the outbound tube 20*a* and the inbound tube 20*b* may have a concave portion 21, such as a groove, or a convex portion (not shown), such as a protrusion, formed on the inner surface thereof.

In this case, the heat transfer area of the inner circumferential surface of the tube 20 may be expanded and the turbulence of the first fluid L1 flowing inside the tube 20 may be promoted, so that the amount of heat exchange may be improved.

Example embodiments have been shown and described, however, the disclosure is not limited to these embodiments. In addition, it should be understood that various modifications may be made by one of ordinary skill in the technical art to which the disclosure belongs, without departing from the spirit and scope of the disclosure, which is defined by the following claims and their equivalents.

What is claimed is:

1. A heat exchanger, comprising:

a shell; and a plurality of tubes disposed inside the shell, wherein the shell includes:

a heat exchange region in which a second refrigerant is to be introduced into the shell, so that a heat exchange occurs between the second refrigerant and a first refrigerant which flows through the plurality of tubes, an inlet region disposed at one side of the heat exchange region, and through which the first refrigerant is introduced into the shell, a reverse region disposed at an other side of the heat exchange region, and into which the first refrigerant is introduced, after the first refrigerant passes through the heat exchange region along at least one of the plurality of tubes, an outlet region into which the first refrigerant is introduced, after the first refrigerant passes through the reverse region and is re-introduced into the heat exchange region, the first refrigerant being discharged out of the shell from the outlet region, and a plurality of partition plates configured to divide the heat exchange region, the inlet region, the reverse region, and the outlet region, wherein the outlet region, the inlet region, the heat exchange region, and the reverse region are arranged sequentially along a lengthwise direction of the shell, wherein the plurality of partition plates includes a first partition plate dividing the outlet region and the inlet region, a second partition plate dividing the inlet region and the heat exchange region, and a third partition plate dividing the heat exchange region and the reverse region, and wherein the first partition plate, the second partition plate and the third partition plate are arranged sequentially along a lengthwise direction of the shell.

2. The heat exchanger of claim 1, wherein each of the plurality of tubes is configured to pass through at least two partition plates among the plurality of partition plates, and each of the plurality of tubes includes:

an outbound tube through which the first refrigerant flows from the inlet region to the reverse region, and an inbound tube separated from the outbound tube, and through which the first refrigerant flows from the reverse region to the outlet region.

3. The heat exchanger of claim 2, wherein one end of the outbound tube through which the first refrigerant is introduced into the outbound tube is disposed in the inlet region, and an other end of the outbound tube through which the first refrigerant is discharged from the outbound tube is disposed in the reverse region, and one end of the inbound tube through which the first refrigerant is introduced into the inbound tube is disposed in the reverse region, and an other end of the inbound tube through which the first refrigerant is discharged from the inbound tube is disposed in the outlet region.

4. The heat exchanger of claim 3, wherein the outbound tube has a length different from a length of the inbound tube.

5. The heat exchanger of claim 2, wherein the outbound tube is configured to pass through the second partition plate and the third partition plate, and the inbound tube is configured to pass through the first partition plate, the second partition plate, and the third partition plate.

6. The heat exchanger of claim 5, wherein the outlet region is disposed at one side end in a lengthwise direction of the shell, and the reverse region is disposed at an other side end in the lengthwise direction of the shell.

7. The heat exchanger of claim 2, wherein the shell further includes an inlet port through which the first refrigerant is introduced into the inlet region and an outlet port through which the first refrigerant is discharged from the outlet region, the inlet port is disposed on one side of the shell in a direction perpendicular to a lengthwise direction of the shell, and the outlet port is disposed on an opposite side of the shell in the direction perpendicular to the lengthwise direction of the shell, and the outbound tube is disposed closer to the inlet port than the inbound tube is, and the inbound tube is disposed closer to the outlet port than the outbound tube is.

8. The heat exchanger of claim 2, wherein the shell further includes an inlet port through which the first refrigerant is introduced into the inlet region and an outlet port through which the first refrigerant is discharged from the outlet region, the inlet port is disposed on one side of the shell in a direction perpendicular to a lengthwise direction of the shell, and the outlet port is disposed on an opposite side of the shell in the direction perpendicular to the lengthwise direction of the shell, the outbound tube includes a plurality of outbound tubes and the inbound tube includes a plurality of inbound tubes, and each of the plurality of outbound tubes are partially disposed in the outlet region such that the plurality of outbound tubes extend in the lengthwise direction between a position adjacent to the inlet port to a position adjacent to the outlet port inside the shell, the first refrigerant flowing through the plurality of outbound tubes from the inlet region to the reverse region via the outlet region and the heat exchange region.

9. The heat exchanger of claim 2, wherein the shell further includes a first inlet port through which the first refrigerant is introduced into the inlet region, a first outlet port through which the first refrigerant is discharged from the outlet region, a second inlet port through which the second refrigerant is introduced into the heat exchange region, and a second outlet port through which the second refrigerant is discharged from the heat exchange region, the second inlet port is disposed on one side of the shell in a direction perpendicular to a lengthwise direction of the shell, and the second outlet port is disposed on an opposite side of the shell in the direction perpendicular to the lengthwise direction of the shell, the outbound tube includes a plurality of outbound tubes and the inbound tube includes a plurality of inbound tubes, the plurality of outbound tubes are disposed in a central portion of the shell with respect to the direction perpendicular to the lengthwise direction of the shell, and the plurality of inbound tubes are disposed closer to the second inlet port or the second outlet port than the plurality of outbound tubes are.

10. The heat exchanger of claim 2, wherein the shell includes a plurality of baffles configured to change a flow direction of the second refrigerant flowing in the heat exchange region, and the plurality of baffles are disposed in the heat exchange region and are spaced apart from each other in a lengthwise direction of the shell.

11. The heat exchanger of claim 2, wherein the shell includes a baffle configured to change a flow direction of the second refrigerant flowing in the heat exchange region, and the baffle is disposed in the heat exchange region between adjacent tubes among the plurality of tubes and extends in a lengthwise direction of the shell.

12. The heat exchanger of claim 2, wherein the plurality of tubes further include a plurality of heat transfer surfaces radially extending from outer circumferential surfaces of the plurality of tubes, and the plurality of heat transfer surfaces are disposed on portions of the plurality of tubes which are disposed in the heat exchange region.

13. The heat exchanger of claim 10, wherein adjacent baffles among the plurality of baffles are disposed at a downstream side of the second refrigerant and are spaced apart from each other by a first interval, and adjacent baffles among the plurality of baffles are disposed at an upstream side of the second refrigerant and are spaced apart from each other by a second interval, the second interval being greater than the first interval.

14. The heat exchanger of claim 12, wherein adjacent heat transfer surfaces among the plurality of heat transfer surfaces are disposed at a downstream side of the second refrigerant and are spaced apart from each other by a first interval, and adjacent heat transfer surfaces among the plurality of heat transfer surfaces are disposed at an upstream side of the second refrigerant and are spaced apart from each other by a second interval, the second interval being greater than the first interval.

15. An air conditioner, comprising:

a compressor; and a heat exchanger connected to the compressor to form at least part of a refrigerant circuit of the air conditioner, and the heat exchanger comprising:

a shell; and a plurality of tubes disposed inside the shell, wherein the shell includes:

a heat exchange region in which a second refrigerant is to be introduced into the shell, so that a heat exchange occurs between the second refrigerant and a first refrigerant which flows through the plurality of tubes, an inlet region disposed at one side of the heat exchange region, and through which the first refrigerant is introduced into the shell, a reverse region disposed at an other side of the heat exchange region, and into which the first refrigerant is introduced, after the first refrigerant passes through the heat exchange region along at least one of the plurality of tubes, an outlet region into which the first refrigerant is introduced, after the first refrigerant passes through the reverse region and is re-introduced into the heat exchange region, the first refrigerant being discharged out of the shell from the outlet region, and a plurality of partition plates configured to divide the heat exchange region, the inlet region, the reverse region, and the outlet region, wherein the outlet region, the inlet region, the heat exchange region, and the reverse region are arranged sequentially along a lengthwise direction of the shell, wherein the plurality of partition plates includes a first partition plate dividing the outlet region and the inlet region, a second partition plate dividing the inlet region and the heat exchange region, and a third partition plate dividing the heat exchange region and the reverse region, and wherein the first partition plate, the second partition plate and the third partition plate are arranged sequentially along a lengthwise direction of the shell.

16. The air conditioner of claim 15, wherein each of the plurality of tubes is configured to pass through at least two partition plates among the plurality of partition plates, and each of the plurality of tubes includes:

an outbound tube through which the first refrigerant flows from the inlet region to the reverse region, and an inbound tube separated from the outbound tube, and through which the first refrigerant flows from the reverse region to the outlet region.

17. The air conditioner of claim 16, wherein one end of the outbound tube through which the first refrigerant is introduced into the outbound tube is disposed in the inlet region, and an other end of the outbound tube through which the first refrigerant is discharged from the outbound tube is disposed in the reverse region, and one end of the inbound tube through which the first refrigerant is introduced into the inbound tube is disposed in the reverse region, and an other end of the inbound tube through which the first refrigerant is discharged from the inbound tube is disposed in the outlet region.

18. The air conditioner of claim 17, wherein the outbound tube has a length different from a length of the inbound tube.

* * * * *